United States Patent [19]

Cline

[11] 4,270,789

[45] Jun. 2, 1981

[54] AIRBAG SETTER

[75] Inventor: Jack Cline, Clarksville, Ark.

[73] Assignee: Clarksville Machine Works, Inc., Clarksville, Ark.

[21] Appl. No.: 82,871

[22] Filed: Oct. 9, 1979

[51] Int. Cl.[3] ..... B66C 1/46

[52] U.S. Cl. ..... 294/63 A; 294/93

[58] Field of Search ..... 294/63 R, 63 A, 86 R, 294/87 R, 90, 93, 99 R; 414/71

[56] References Cited

U.S. PATENT DOCUMENTS

| | | | |
|---|---|---|---|
| 2,609,113 | 9/1952 | Huffman | 294/63 A X |
| 3,716,264 | 2/1973 | Pearne et al. | 294/63 A |
| 3,881,762 | 5/1975 | Zappia | 294/63 A X |
| 4,119,217 | 10/1978 | Jones | 294/63 A X |

FOREIGN PATENT DOCUMENTS

| | | | |
|---|---|---|---|
| 187531 | 2/1964 | Sweden | 294/63 A |
| 363595 | 3/1973 | U.S.S.R. | 294/63 A |

*Primary Examiner*—Johnny D. Cherry

[57] ABSTRACT

An improved gripper member for airbag setters formed by a pair of perforated plate members depending from an air manifold and separated at the top, then preferably converging and secured together at the bottom. A sheet of air impervious flexible material is attached at the bottom between an attachment strip and a corresponding surface of one of the plates, then wraps up over the attachment strip and is secured along the upper edge to form an airbag on one side of the perforated plate members. A second sheet of air impervious flexible material is similarly fastened to the other side of the perforated plate.

3 Claims, 2 Drawing Figures

AIRBAG SETTER

BACKGROUND OF THE INVENTION

This invention relates to the manufacture of brick and more particularly to a setter or hacker for accumulating rows of raw cut clay bricks and stacking them into courses on a kiln car in preparation for the firing or curing thereof. Either simultaneously or in preparation for this transfer it is necessary to separate adjacent rows of brick so that the hot air in the kiln can circulate between the rows thereof and cure the brick from all sides. Several general types of apparatuses have been developed for performing this function.

First of all, in a first type of apparatus as illustrated by U.S. Pat. No. to Lingl 3,270,897 and U.S. Pat. No. to Bason 3,260,379, the rows are lifted while adjacent each other either by application of force against the end of the rows or suction on the top of each brick in the row. The rows are then separated while held up by the grippers prior to the time they are deposited on the kiln car.

Another and earlier type of apparatus first delivers the bricks to a spread table where the rows are spaced apart, then utilizes a vast number of gripping members, each of which grips the sides or ends of a single brick and are introduced between adjacent rows of bricks for this purpose. Such types of apparatus are illustrated by the U.S. Pat. Nos. to Luce 1,601,868 and 1,709,138.

A third type of setter or hacker or brick handling frame is known in the prior art in which rows of brick are initially spaced apart on some type of spread table, air expandable grippers are inserted in the spaces between each pair of adjacent rows, and air is introduced to flexible bags of grippers which expand outwardly and grab the adjacent bricks therebetween. Examples of such types of air bag frames include the U.S. Pat. No. to Francis 3,161,431; the U.S. Pat. No. to Huffman 2,609,113; the Canadian Pat. No. to Wikdahl 611,168; and the Belgian Pat. No. to AFMA 539,465. In more recent years apparatuses as illustrated and described in the U.S. Pat. No. to Pearne et al 3,716,264 and U.S. Pat. No. to Jones 4,119,217 have appeared on the market. While each of these types of setters has been able to successfully grip and transport a course of brick, there are certain disadvantages prevelant in each. For example, the lower portion of the bag is subject to extreme wear because of its constant engagement with the rough surfaces of bricks and the plate onto which it is lowered, the structural design make such setters subject to considerable maintenance since the individual grippers are not structurally substantial. Further, some problems are noted as far as the speed with which the air bags are expanded and evacuated.

SUMMARY OF THE PRESENT INVENTION

The present invention is directed to the latter mentioned type of setter, i.e. the "air bag setter" with certain improvements therein for the purpose of providing a quicker expansion and evacuation of the bags, better control of the shape of the bag in both the expanded and the collapsed position, a structurally stronger gripper member, and a gripper which provides protection for the fabric or material out of which the bag itself is formed.

Toward this end, the present invention is directed to an air bag setter or hacker in which the gripping mechanism or members comprise a plurality of tubular air members extending above and parallel to the space between the adjacent rows of the brick and connecting a manifold carrying source of compressed air with the gripping members below. A pair of plate members depend from each tubular air member and extend along a path substantially parallel to and equal in length to the rows of bricks being lifted. The plates are separated at the top thereof and converge at the bottom where they are secured together by welding or some other suitable securing means. An attachment strip is removably secured to the outer surface of each side of the plate members along the bottom edge thereof beneath which a sheet of air impervious flexible material is secured. The flexible material extends up across the corresponding surface of each side of the plate and is attached along the top edge thereof, it being understood that the central portion of the flexible material loosely confronts the plate, however, is not secured thereto. Each of the plates includes a plurality of cooperating openings therein which cooperate with other openings in the tubular member and in the block which separates the plates at the top thereof to provide an air path between the source of air and the interior of each of the air bags. A controlled source of air pressure is provided which provides a positive inflow of air into the bags to move them to the gripping position, however, provides a negative source of air pressure or suction upon evacuation to cause the bags to evacuate to the relaxed position more quickly, thereby dropping the bricks more evenly and under more control than with apparatuses known heretofore.

It is an object of the present invention to provide an improved air bag type setter for bricks.

Another object of the present invention is to provide an improved gripping mechanism for air bag setters in which the air bag itself is expanded and evacuated more quickly.

Yet another object of the present invention is to provide an improved gripping member for air bag setters in which the material which forms the air bag is better protected for longer wear.

Still another object of the present invention is to provide a gripping member for air bag setters, which gripping member is structurally stronger than those known heretofore.

Other objects and a fuller understanding of the invention will become apparent upon reading the following detailed description of a preferred embodiment along with the accompanying drawings in which.

DETAILED DESCRIPTION OF A PREFERRED EMBODIMENT

Figure 1:
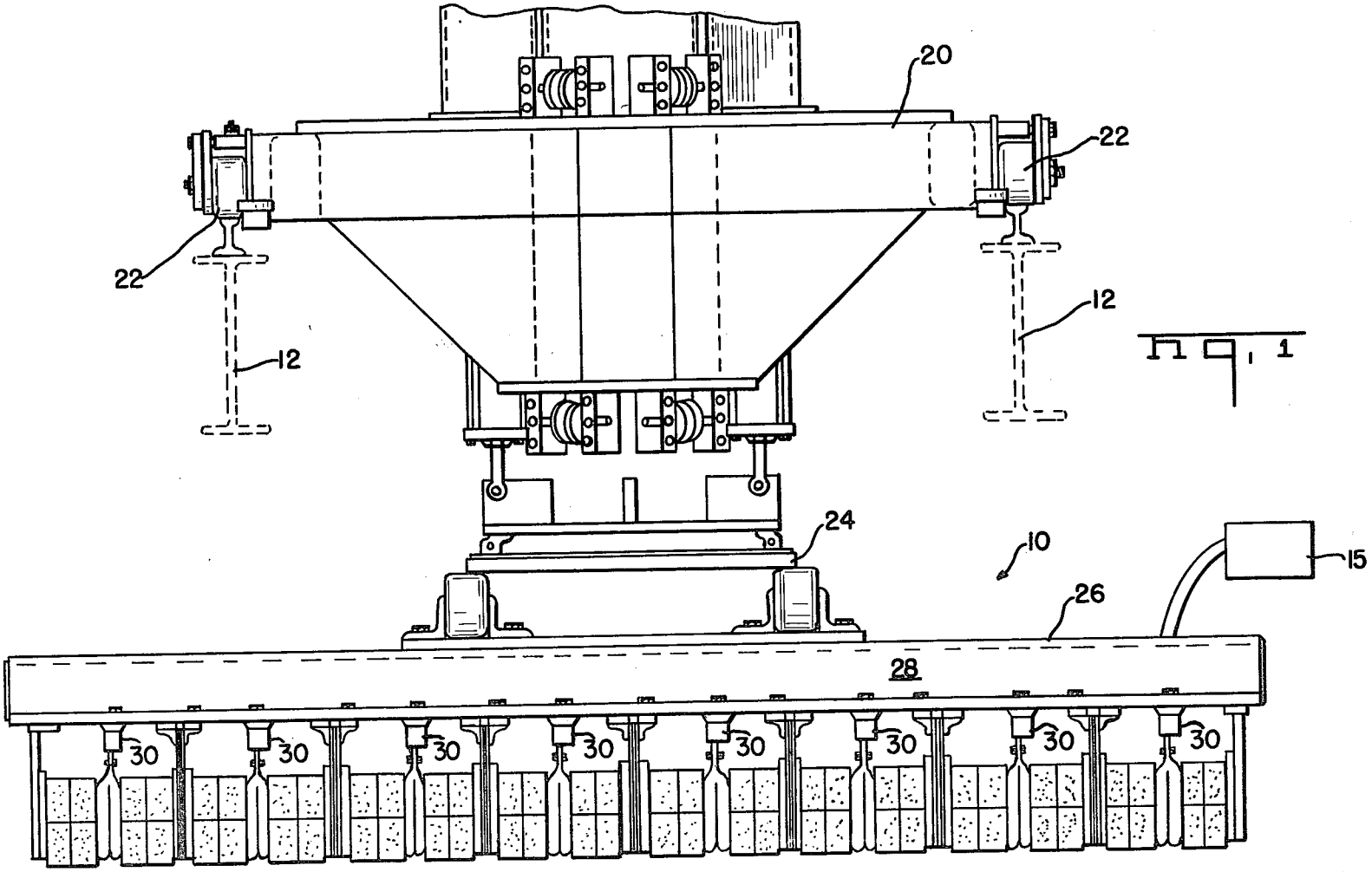
FIG. 1 is a side elevational view of the brick gripping assembly.

Turning now to the drawings, and particularly to FIG. 1, there is illustrated an assembly of the improved gripper members mounted on a setter head 10. In this regard, a frame or framework 12 is built above the area at the end of the marshalling conveyor at which the spread table (not shown) is located. The frame 12 extends from this point across to the kiln car loading area. A setter carriage 20 is mounted on rollers 22 on support frame 12 which provides reciprocation of the carriage between a position over the spread table (pick up position) and a position atop the kiln car (closed position) deposit area.

Further, the carriage 20 includes a means for rotating the gripper frame 26 therebeneath 90° to alternately stack courses perpendicular with respect to each other after they are gripped. The gripper frame 26 is rotatably connected to the carriage 20 through a rotation assembly 24 which rotates the frame about a vertical axis from the position illustrated through a 90° rotation.

In general the gripper frame 26 supports a plurality of gripper assemblies 30 in spaced relation to each other, the aforementioned spaced relation corresponding to and parallel with the open spaces formed in the spread table therebeneath when the spread table is in the spread or open position. A manifold 28 receives air from a source of both positive and negative air pressure 15 and delivers such air to and from each gripper assembly 30.

The aforementioned structure is conventional on all setting assemblies, particularly on all of those which utilize the air bag concept, and it is not the frame or carriage structure which form the heart of the present invention. For example, such a gripper frame is illustrated in U.S. Pat. No. 3,716,264 to Pearne et al, the disclosure of which is incorporated by reference herein. Therefore, it is felt that sufficient description has been made of the support structure, the remainder of the specification will be directed to the gripper assemblies themselves.

Figure 2:
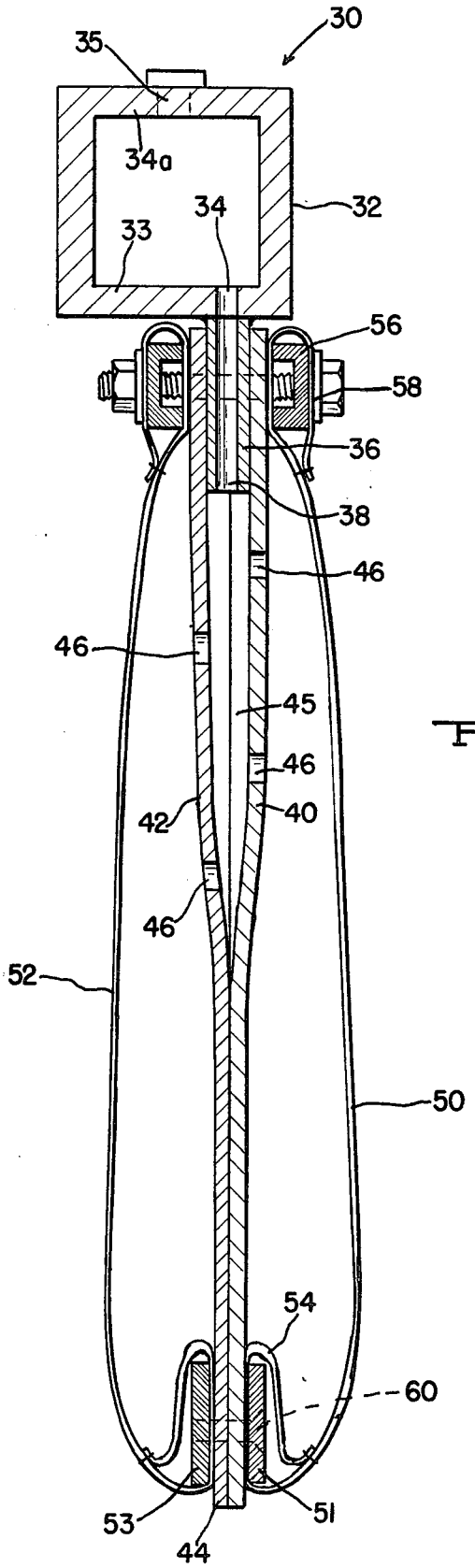
FIG. 2 is a greatly enlarged cross-sectional view of a single air bag gripper member according to the present invention.

Turning now to the gripper assemblies 30 themselves, each gripper assembly includes a longitudinal tubular member 32 which extends substantially the entire length of the rows of bricks to be picked up. A plurality of openings 34 extend through the bottom wall 33 of the tubular member at spaced points therealong, preferably about six inches apart. Other openings 35 in the top wall 34*a* provide communication with manifold 28. A spacer bar 36 approximately equal in length to the tubular member 32 depends therefrom and is welded thereto as illustrated in FIG. 2. A second plurality of openings 38 extend through the spacer bar 36 in locations corresponding to openings 34, so that the air communication between the interior of tubular member 32 and the bottom of openings 38 is continuous.

A pair of backing plates 40, 42, also approximately equal in length with the tubular member 32 are secured, one on either side, along their upper edges to the spacing bar 36. Plates 40,42 are approximately ten inches in height and converge near the lower edge 44 thereof where they are secured together as by welding. So arranged, the plates 40,42 form an air chamber 45 therebetween above the point of convergence and below the separator block 36. A plurality of openings 46 are provided in the walls or plates 40, 42 so that the air in chamber 45 can be selectively pushed through or pulled through openings 46.

To complete forming of the gripper assembly, a first sheet of air impervious flexible material 50 is secured in spaced relation to the plate 40 and a second sheet 52 of similar material is secured in facing arrangement to plate 42. Since sheets 50 and 52 are secured in exactly the same manner, a description of one will suffice for the other.

The lower edge of sheet 50 is positioned intermediate the lower edge of plate 40 and a first attachment strip 51, which secures the lower edge of sheet 50 to plate 40 by means of screws 60 or the like which extend through the strip 51, through the lower edge of sheet 50, through plates 40,42, through the lower edge of sheet 52 and through the second attachment strip 53. If desired, a hem 54 can be provided through which the attachment strip 51 is slipped, thereby providing the flexible material entirely around the attachment strip 51, preventing damage to the bricks in case of inadvertent engagement therewith. Preferably also, the lower edges 44 of the converging portion of plates 40,42 extend slightly below the point of attachment of attachment strip 51 so that damage to the bag is prevented in case a plate or other hard surface is engaged which would cause damage to the bag.

As is illustrated in FIG. 2, the fabric forming sheet 50 extends out the bottom of the intersection between attachment strip 51 and plate 40 and then curves back up over the attachment strip 51 to the top of plate 40 where it is secured beneath an upper attachment strip 56. As is the case in the attachment of the lower edge of the bag 50 the upper edge may also be provided with a hem 58 which prevents damage to the bricks by covering the metallic portions of the upper strip 56.

Sheet 52 is attached to plate 42 in exactly the same manner and it is not felt that further description is necessary. The side edges of sheets 50 and 52 are sewed together in airtight relation thereto to prevent inadvertent escape of air.

Although one specific manner in which the sheets 50,52 are secured to plates 40,42 has been described in detail, it is apparent that various other methods might be utilized to attach the sheets to opposite sides of plates 40,42 without departing from the scope of the present invention which is directed to the support plates 40,42, and the manner in which they deliver and exhaust the air to more efficiently activate and deactivate the air bags. Further, the structure to which the sheets 50 and 52 are connected provide a stronger, more sturdy and long lasting structure than those known heretofore.

While a preferred embodiment of the invention has been shown and described in detail hereinabove it is obvious that various changes and modifications might be made without departing from the scope of the invention which is set forth by the claims hereinbelow.

What is claimed is:

1. In a brick setting apparatus of the type having a vertically and horizontally movable frame, a plurality of spaced gripper members depending from said frame and between which spaced rows of brick are gripped, then lifted and moved the improvement whereby each of said spaced gripper members comprises:

(a) a tubular member extending above and parallel to the space between two adjacent rows of brick and forming a manifold connecting a source of positive and negative air pressure with the gripping member therebelow;

(b) a pair of plate members depending from said tubular member and extending along a path substantially parallel to and equal in length to the rows of bricks being lifted, means for separating said plate members at the top thereof adjacent said manifold, said plate members converging and secured together at the bottom thereof;

(c) an attachment strip removably secured to the outer surface of each of said plate members along the bottom edge thereof;

(d) a separate sheet of air impervious flexible material having the bottom edge thereof positioned intermediate each of said attachment strips and the corresponding surface of each of said plate members, said sheet protruding from the space between said attachment strip and said plate member, means for attaching the upper edge of said sheet to the upper edge of said plate member, the corresponding side edges of each of said separate sheets being secured together thereby forming an air bag on either side of said plate members;

(e) cooperating openings in said plate member separating means and said plate members for providing an air path between the source of positive and negative air pressure and the interior of each of said air bags;

(f) whereby said air bags may be expanded to a gripping position by introduction of air into said air bags and relaxed to a release position by evacuation of air from said air bags while maintaining control of the bag shape.

2. The improvement according to claim 1 wherein each of said sheets of air impervious flexible material includes a hem extending along at least the bottom edge thereof surrounding said attachment strip whereby damage to the bricks is prevented in case the gripper member accidentally engages a brick as it is lowered.

3. The improvement according to claim 2 wherein said plate members extend below said attachment strips to protect the hem of the bag member from engagement with the surface on which the bricks are arranged prior to and subsequent to the setting operation.

* * * * *